US006877261B2

(12) United States Patent
Milton

(10) Patent No.: US 6,877,261 B2
(45) Date of Patent: Apr. 12, 2005

(54) FABRIC TENSIONER AND METHOD OF TENSIONING FABRIC

(76) Inventor: Ian Edward Milton, 58 Barnell Village, Near Oundle, Peterborough PE8 5PG (GB)

( * ) Notice: Subject to any disclaimer, the term of this patent is extended or adjusted under 35 U.S.C. 154(b) by 0 days.

(21) Appl. No.: 10/399,591

(22) PCT Filed: Oct. 17, 2001

(86) PCT No.: PCT/GB01/04622

§ 371 (c)(1),
(2), (4) Date: Aug. 12, 2003

(87) PCT Pub. No.: WO02/33201

PCT Pub. Date: Apr. 25, 2002

(65) Prior Publication Data

US 2004/0025383 A1 Feb. 12, 2004

(30) Foreign Application Priority Data

Oct. 18, 2000 (GB) ..... 0025568

(51) Int. Cl.[7] ..... D06C 3/08
(52) U.S. Cl. ..... 38/102.8
(58) Field of Search ..... 38/102, 102.91, 38/102.8, 102.4, 102.3, 102.2; 160/371, 372, 374.1, 378, 388, 389, 402, 399; 40/606.01, 606.14, 611.12

(56) References Cited

U.S. PATENT DOCUMENTS 1,249,057 A * 12/1917 Finley ..... 38/102.2
2,180,059 A * 11/1939 Kandle ..... 38/102.2
5,033,216 A * 7/1991 Gandy et al. ..... 40/603
5,581,918 A * 12/1996 Schilling et al. ..... 38/102.1
5,647,157 A * 7/1997 Kasahara ..... 40/792

FOREIGN PATENT DOCUMENTS

| | | |
|---|---|---|
| DE | 8523293.9 | 9/1985 |
| DE | 8701466 | 3/1987 |
| FR | 2732395 | 4/1996 |
| GB | 898459 | 6/1962 |
| GB | 2 270 935 | 3/1994 |
| JP | 6299736 | 10/1994 |
| JP | 6299737 | 10/1994 |
| WO | WO 87/01154 | 2/1987 |

* cited by examiner

*Primary Examiner*—Ismael Izaguirre
(74) *Attorney, Agent, or Firm*—Keusey, Tutunjian & Bitetto, P.C.

(57) ABSTRACT

The present invention relates to a method and apparatus for tensioning fabric and particularly, but not exclusively, to a method and apparatus for tensioning a fabric support by a frame in a marquee. A tensioner (2) is provided with a mounting device (4) for mounting the tensioner to a frame (100) of a marquee and a connector (6, 8, 42), which connects the mounting device (4) to a fabric to be tensioned. The connector (6, 8, 42) includes a resiliently bendable elongate member, (6, 8) which is resiliently connected to the mounting device (4) and includes an engagement device (42) which engages the fabric so as to permit a transfer of force between the fabric and the mounting device (4). The tensioner thereby allows fabric to be tensioned in a convenient and rapid manner.

15 Claims, 3 Drawing Sheets

FABRIC TENSIONER AND METHOD OF TENSIONING FABRIC

FIELD OF THE INVENTION

The present invention relates to a method and apparatus for tensioning fabric and particularly, but not exclusively, to a method and apparatus for tensioning a fabric supported by a frame in a marquee.

DESCRIPTION OF RELATED ART

It is well understood in the art that the fabric of a marquee should be preferably tensioned in order to improve structural and aesthetic quality. Tensioning of roof and gable fabric has generally been achieved with straps which extend from the fabric to the ground or the base of the marquee frame structure. By manually pulling the ends of such straps adjacent the ground or frame base, the straps and associated roof/gable fabric are tensioned. However; a tensioning strap extending down the side wall of a marquee can be problematic when two marquees are to be located in close proximity to one another with a guttering extending between adjacent walls. Specifically, it has in the past been necessary to pass the tensioning straps through custom made, slits in guttering which has the consequential affect of allowing water to escape from the guttering in an undesirable fashion.

This problem has been overcome to a certain extent by the provision of a tensioning system comprising a circular disc rotatably mounted to a marquee frame adjacent the roof line. The disc is rotatably mounted off-center and in a vertical plane so that, when the disc is rotated, roof/gable fabric engaging the lowermost peripheral edge of the disc may be pressed downwards in a camming action. This system however is not entirely satisfactory since the disc can be awkward to rotate, the amount of tension applied cannot be adjusted, and the disc itself is in an inherently unstable condition when rotated to the tensioning position. As a consequence of the latter characteristic, there is an inherent tendency for the disc to undesirably move to a non-tensioning position. The provision of the disc on the side of a marquee can also be unsightly.

SUMMARY OF THE INVENTION

A first aspect of the present invention provides a fabric tensioner for use in tensioning a fabric supported by a frame of a marquee, the tensioner comprising means for mounting the tensioner to a frame of a marquee; and means for connecting said mounting means to a fabric to be tensioned, wherein said connecting means comprises a resiliently bendable elongate member being resiliently connected to said mounting means and comprises means for engaging said fabric so as to permit a transfer of force between said fabric and said mounting means.

Accordingly, the present invention provides fabric tensioning apparatus which may be attached to the frame of a marquee through use of the aforementioned mounting means. Once the tensioner has been mounted to a marquee frame, the connecting means may be resiliently bent so that the fabric engaging means may be appropriately attached to fabric to be tensioned. The resiliently bendable elongate member may be of a one-piece elastic material such as rubber. The resiliently bendable elongate member may comprise two or more rigid members hingedly connected together to allow resilient bending. Attachment of the fabric engaging means is also assisted by means of the resilient connection between the connecting means and the mounting means. Again, this resilient connection may be of a one-piece rubber construction so that the entire fabric tensioner may in practice be manufactured as a one-piece resilient component. Once the fabric engaging means has been attached to the fabric, the connecting means may be moved from its bent position so that the fabric is pushed or pulled into tension. The fabric tensioner may be configured so that, when tensioned, the fabric tends to pull the connecting means against the frame of the marquee preventing movement of the connecting means to its bent position and a subsequent relaxation of the fabric.

It is preferable for said connecting means to be resiliently connected to said mounting means by means of a pivot connection. Said connecting means may be telescopically extendible. Said fabric engaging means may also comprise a rod for locating within an aperture in said fabric. Said rod is preferably provided with means for resisting a tendency for said rod to move from said fabric aperture during use. Said resisting means may comprise a member extending laterally from said rod. It is further preferable for said laterally extending member to be a flange. It is also preferable for said resisting means to be of resilient material such as rubber or a plastics material.

It is particularly desirable for said resiliently bendable elongate member to comprise first and second members pivotally connected to one another. It is also preferable for said mounting means to be connected to said first member and for said fabric engaging means to be provided on said second member, the pivot connection between said first and second members being located between end portions of the first member. Said pivot connection between said first and second members may be located nearer to the resilient connection of said first member to said mounting means than to the end of said first member distal to said resilient connection.

Furthermore, it is preferable for said second member to comprise two members telescopically mounted to one another by means of cooperating screw threads. One of said telescopically mounted members is preferably connected to said first member and the other one of said telescopically mounted members is preferably provided with said fabric engaging means. Said mounting means may also be adapted to secure the fabric tensioner to a frame of a marquee by means of a pin, associated with said mounting means, which in use locates in a hole in said frame.

A second aspect of the present invention provides a method of using the aforementioned fabric tensioner, wherein the method comprises the steps of mounting the fabric tensioner to a frame of a marquee by means of the mounting means; moving the connecting means to a resiliently bent position; engaging the fabric engaging means with fabric to be tensioned; and moving the connecting means from the resiliently bent position so as to tension said fabric.

BRIEF DESCRIPTION OF THE DRAWINGS

Embodiments of the present invention will now be described with reference to the accompanying drawings, in which.

DETAILED DESCRIPTION OF PREFERRED EMBODIMENTS

A first embodiment 2 of the present invention is schematically shown in FIGS. 1–5 of the accompanying drawings. The first embodiment 2 comprises three components 4, 6, 8 which are connected to one another by means of two pivots 10, 12.

Figure 1:
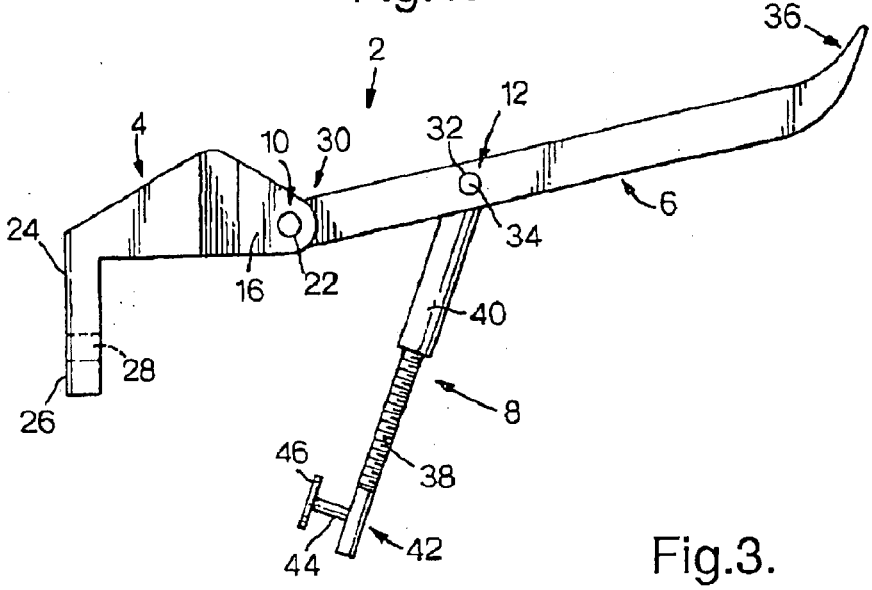
FIG. 1 is a side view of a first embodiment of the present invention.
Figure 3:
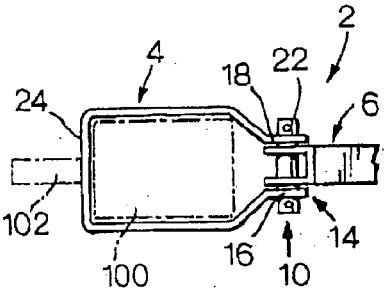
FIG. 3 is a plan view of the first embodiment secured to a post shown with broken lines.
Figure 2:
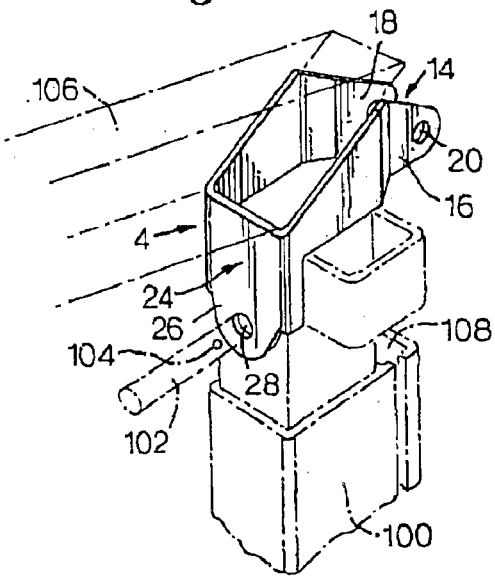
FIG. 2 is a perspective view of a mounting member of the first embodiment secured to a post shown with broken lines.

The first of the three components is a mounting member 4 for mounting the first embodiment 2 to a post of a marquee. The configuration of the mounting member 4 is most clearly shown in the schematic perspective view of FIG. 2. The mounting member 4 may be conveniently manufactured from sheet material by stamping a required profile from said sheet and bending the profile into an open box section for conforming with a marquee post as shown in FIG. 3. The mounting member 4 may be stamped from 1.5 mm to 2.0 mm sheet steel. Appropriate materials and manufacturing techniques will be readily understood and apparent to a reader skilled in the art.

As will be seen from the accompanying drawings, the mounting member 4 takes the form of an open box section. An open end 14 thereof (see FIGS. 2 and 3) allows the mounting member 4 to the resiliently sprung-fitted about a marquee post. The open end 14 is defined by two parallel lobes 16, 18 which are each provided with a circular aperture 20 for receiving a first pivot pin 22. It will also be seen from the accompanying drawings that the side 24 of the mounting member 4 opposite the open end 14 is provided at its lower edge with a lobe 26 having a circular aperture 28 defined therein. In use, the circular aperture 28 receives a pin for fixing the position of the mounting member 4 relative to a marquee post.

The second component is a lever member 6 which may be fabricated from sheet metal so as to define an elongate member having a C-section. A first end 30 of the lever member 6 is provided with circular apertures (not shown) for aligning with the circular apertures 20 adjacent the open end 14 of the mounting member 4 and subsequent reception of the first pivot pin 22. In the assembled embodiment 2, the first end 30 of the lever member 6 is received within the open end 14 of the mounting member 4 and pivotally secured thereto by means of the first pivot pin 22. The first pivot pin 22 extends through the aforementioned aligned apertures and is itself secured in place by means of a nut (not shown) threadedly engaged with an end thereof. The nut, in combination with a flange provided on a distal end of the pin 22, prevents the pivot pin 22 from falling from said aligned apertures.

Side walls of the C-section lever member 6 are provided with further circular apertures 32 which, in the assembled embodiment 2, receive a second pivot pin 34. A second end 36 of the lever member 6 is appropriately shaped so as to allow a user to safely apply a tensioning force to said end 36 by hand.

Figure 5:
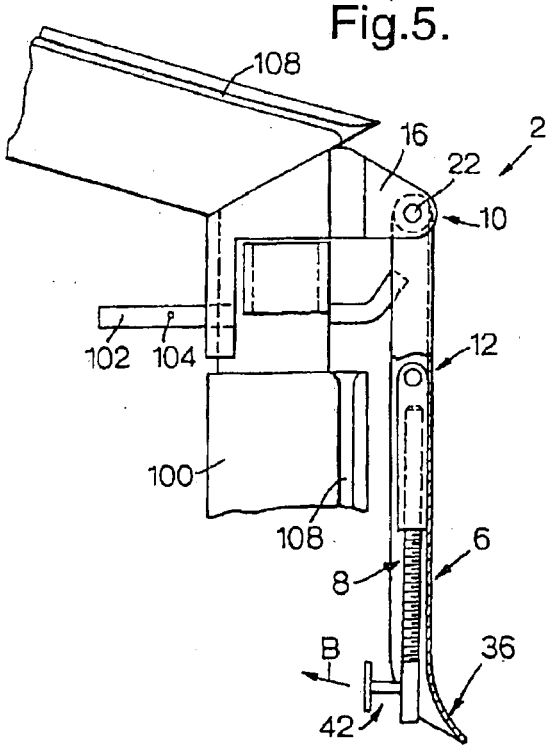
FIG. 5 is a side view of the first embodiment in a tensioning configuration whilst secured to a post.

The third component of the embodiment 2 is a telescopically extendible fabric connecting member 8. The connecting member 8 comprises a metal bar 38 having external screw threads for threaded engagement with internal screw threads of a metal cylindrical member 40. The bar 38 and cylindrical member 40 thereby cooperate to define the telescopically extendible connecting member 8. The connecting member 8 is pivotally attached to the lever member 6 by means of circular apertures (not shown) provided in the cylindrical member 40 for aligning with the circular apertures 32 of the lever member 6 and subsequent reception of the second pivot pin 34. The lever and connecting members 6, 8 are dimensioned so that the connecting member 8 may pivot relative to the lever member 6 and lie in the C-section of the lever member 6 as shown in FIG. 5. The second pivot pin 34 may be secured in position by means of a threaded nut as described in respect of the first pivot pin 22. Alternative means of providing an appropriate pivot connection between the three components 4, 6, 8 will be readily apparent to a reader skilled in the art.

A fabric engaging member 42 is provided on the end of the connecting member 8 distal to the pivotal connection with the lever member 6. The fabric engaging member 42 comprises a short rod 44 extending perpendicularly to the bar 38. The end of the rod 44 is provided with a circular disc 46. The disc 46 may be manufactured from metal or a more flexible material such as rubber. In use, the disc 46 and rod 44 are pressed through a custom made aperture in fabric to be tensioned. Once the engaging member 42 is in position, the circular disc 46 tends to prevent the engaging member 42 from falling from the custom made fabric aperture.

The three components 4, 6, 8 and pivots 10, 12 of the first embodiment 2 are preferably made of galvanized steel so as to ensure acceptable durability in harsh weather conditions.

Operation of the first embodiment 2 is clearly shown in FIGS. 2–5 of the accompanying drawings. The embodiment 2 may be used to tension the fabric roof of a marquee by mounting the embodiment 2 to the top of a vertical side wall post 100 of a marquee frame. This may be achieved by resiliently expanding the open end 14 of the mounting member 4 so that the mounting member 4 may be pressed over a marquee post 100 prior to assembly of the first pivot 10 (see FIG. 2). Once the mounting member 4 has been positioned about a post 100, the first pivot 10 may be assembled in accordance with the above (see FIG. 3). Although the spring fit of the mounting member 4 about the marquee post 100 may be sufficient to prevent the embodiment 2 from slipping relative to said post 100, it is likely that means in addition to the friction fit between the mounting member 4 and post 100 will be desirable to prevent relative movement therebetween when tensioning. As shown in FIGS. 2–5, this additional means comprises a post pin 102 which, by means of appropriate apertures, extends from one side of the post 100 to an opposite side thereof and may be pressed through the circular aperture 28 provided on the side 24 of the mounting member 4. In this way, movement of the mounting member 4 relative to the post 100 is prevented. The post pin 102 may be bent at one end and provided with a laterally extending hole 104 at an opposite end for receiving a clip (not shown) so as to prevent accidental removal of the post pin 102 from the aforementioned apertures. The post pin 102 is preferably of a durable material such as galvanized steel. The arrangement is such that the embodiment 2 can be conveniently retro-fitted to existing marquee posts.

Figure 4:
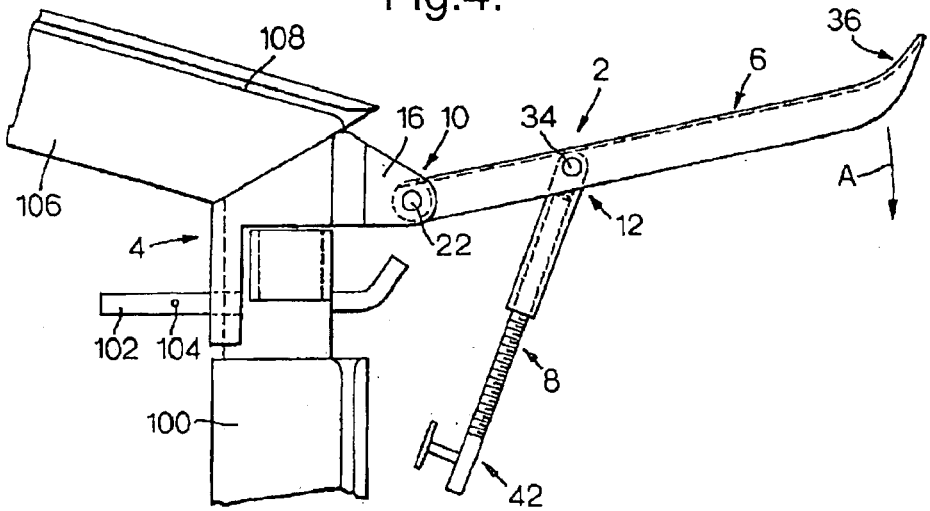
FIG. 4 is a side view of the first embodiment in a non-tensioning configuration whilst secured to a post.

Once secured to a marquee post, the embodiment 2 may be used to tension fabric supported by said post. In FIGS. 4 and 5 in particular, a post 100 is shown supporting a roof beam 106. The post 100 and roof beam 106 combine with similar components to provide a frame structure for supporting the fabric of a marquee. The fabric is attached to this frame by means of a bead and groove arrangement wherein beading integral with the fabric is slidably located within grooves 108 defined in the side wall post and roof beam members 100, 106.

With reference to FIGS. 4 and 5, it will be seen that a tension force may be applied to roof fabric supported by the roof beam 106 by attaching the fabric engaging member 42 to said roof fabric and pressing the end 36 of the lever member 6 in the direction of arrow A (see FIG. 4) towards the position shown in FIG. 5. The rod 44 and disc 46 of the fabric engaging member 42 may be inserted through a metal eye provided either in the roof fabric itself or a strap extending from said roof fabric. For the purposes of clarity, the fabric to be tensioned is not shown in FIGS. 2–5.

In moving the lever member 6 in the direction of arrow A, the fabric engaging member 42 is moved in a downward direction. Roof fabric is thereby also pushed in a downward direction and tensioned as a consequence. Considerable tensioning force may be readily applied by a user who presses on the end 36 of the lever member 6 distal to the mounting member 4. In this way, significant leverage can be generated.

The configuration of the embodiment 2 is such that an over-center arrangement is provided. Specifically, the first pivot 10 is sufficiently spaced from the vertical post 100 when in use for the lever member 6 to be able to pass from the stable position shown in FIG. 4 through an unstable position to a second stable position shown in FIG. 5 wherein the reaction force exerted by the tensioned fabric tends to pull the lever member 6 and fabric connecting member 8 in the direction of arrow B (see FIG. 5) and into abutment with the post 100. The embodiment 2 may therefore be conveniently moved from a stable non-tensioning position (shown in FIG. 4) to a stable tensioning position (shown in FIG. 5) in a rapid and effective manner.

Furthermore, the amount of tension applied to the roof fabric when in the stable tensioning position may be adjusted by telescopically extending or retracting the bar 38 relative to the cylindrical member 40 prior to securing the fabric engaging member 42 to the roof fabric when in the non-tensioning position. In this way, the tension applied to the roof fabric may be increased by telescopically extending the length of the fabric connecting member 8 or, alternatively, decreased by telescopically reducing the length of the connecting member 8.

The present invention is not limited to the specific embodiment or method described above. Alternative arrangements and suitable materials will be apparent to a reader skilled in the art. For example, in circumstances where the post 100 is too large for a mounting member 4 to be sprung fitted thereto, it will be necessary to provide the mounting member 4 as a two-piece component. Each piece will comprise a side 24 having a circular aperture 28 defined therein for receiving a post pin 102. Each piece will also comprise a circular aperture 20 for receiving the first pivot pin 22. In use, the two pieces will locate on opposite sides of a post 100 with the circular apertures 28 coaxially aligned for reception of the post pin 102. The two apertures 20 will also be coaxially aligned for reception of the first pivot pin 22 which, once in position with a nut threadedly attached thereto, will retain the two pieces of the mounting member 4 together.

Figure 6:
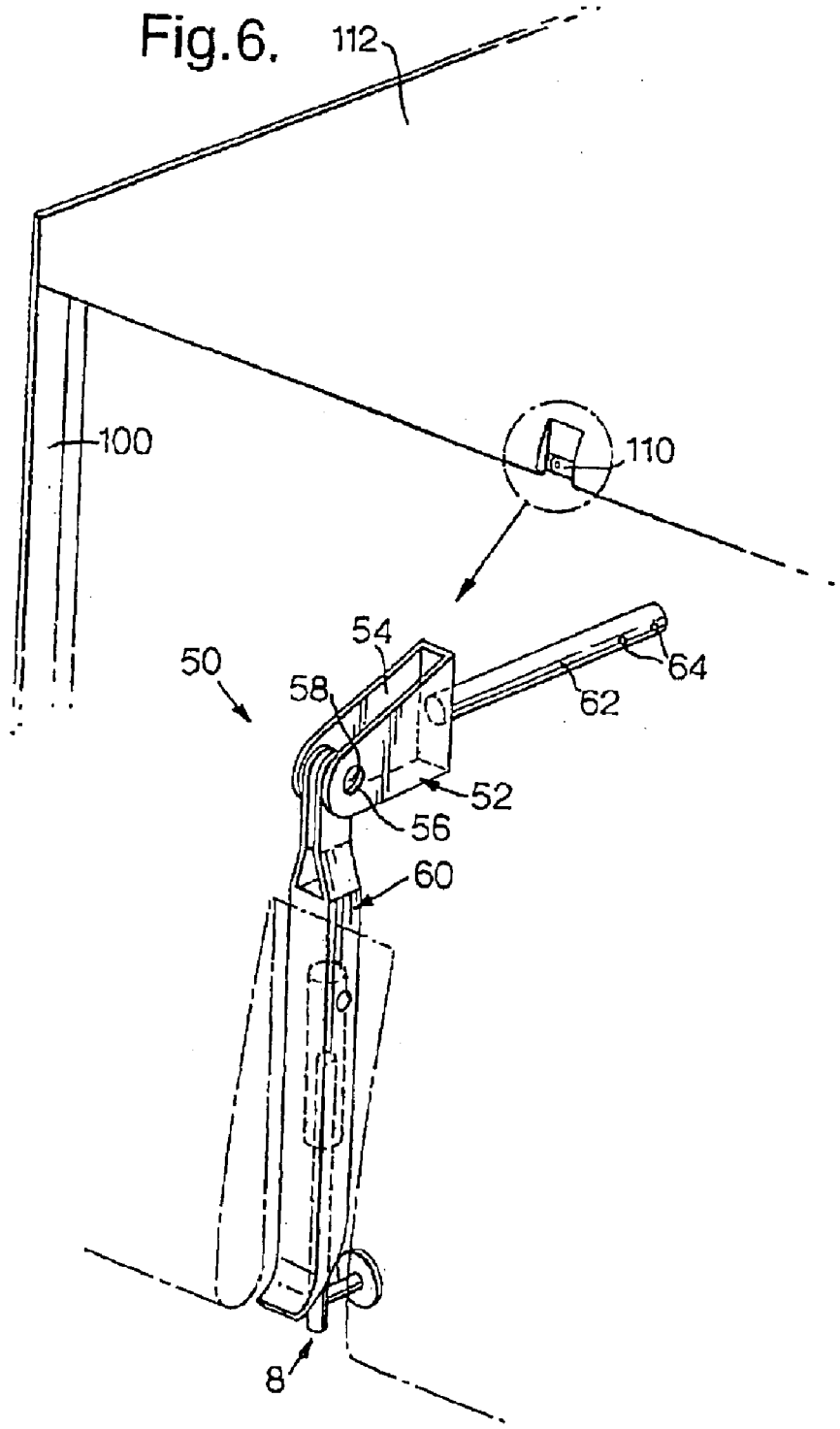
FIG. 6 is a perspective view of a second embodiment of the present invention in a tensioning configuration.

As a further alternative. FIG. 6 shows a schematic view of a second embodiment 50. The second embodiment 50 is identical to the first embodiment 2 except for modifications to the mounting member and to the end of the lever member connected to said mounting member. As will be seen from FIG. 6, the second embodiment 50 comprises a mounting member 52 which allows for mounting of the second embodiment 50 to a gable tension bar 110. The mounting member 52 comprises a section 54 stamped and folded from sheet metal. This section 54 comprises two axially aligned circular apertures 56 (corresponding to the circular apertures 20 of the mounting member 4 of the first embodiment 2) for receiving a pivot pin. 58 to which a lever member 60 is pivotally secured. The mounting member 52 is not required to fit around a post or other member of a marquee frame and, accordingly, is of a relatively slim design. This results in the apertures 56 being closer to one another than the corresponding apertures 20 of the first embodiment 2. As a consequence, the end of the lever member 60 attached to the mounting member 52 is narrower than the corresponding end of the lever member 6 of the first embodiment 2.

In addition to the aforementioned section 54 of the mounting member 52, the mounting member 52 also comprises a metal rod 62. The rod 62 extends perpendicularly to the aligned axes of the mounting member apertures 56. The second embodiment 50 may be thereby mounting to a gable tension bar 110 by inserting the rod 62 through a hole in said bar 110 and securing the rod 62 in position by locating appropriate clips in holes 64 extending laterally through the end of the rod 62 distal to the section 54 of the mounting member 52. Once the second embodiment 50 has been secured to a gable tension bar 110, gable fabric 112 may be tensioned in the same manner as described for roof fabric in relation to the first embodiment 2.

What is claimed is:

1. A fabric tensioner for use in tensioning a fabric supported by a frame of a marquee, the tensioner comprising means for mounting the tensioner to a frame of a marquee; and means for connecting said mounting means to a fabric to be tensioned, wherein said connecting means comprises a resiliently bendable elongate member being resiliently connected to said mounting means and comprising means for engaging said fabric so as to permit a transfer of a tensioning force between said fabric and said mounting means; the elongate member comprising first and second members pivotally connected to one another wherein the second member is telescopically extendable.

2. A fabric tensioner as claimed in claim 1, wherein said connecting means is resiliently connected to said mounting means by means of a pivot connection.

3. A fabric tensioner as claimed in claim 1, wherein said fabric engaging means comprises a rod for locating within an aperture in said fabric.

4. A fabric tensioner as claimed in claim 3, wherein said rod is provided with means for resisting a tendency for said rod to move from said fabric aperture during use.

5. A fabric tensioner as claimed in claim 4, wherein said means for resisting comprises a member extending laterally from said rod.

6. A fabric tensioner as claimed in claim 5, wherein said laterally extending member is a flange.

7. A fabric tensioner as claimed in claim 4, wherein said means for resisting is of a resilient material.

8. A fabric tensioner as claimed in claim 7, wherein said resilient material is rubber or a plastics material.

9. A fabric tensioner as claimed in claim 1, wherein said mounting means is connected to the first member of the elongate member and said fabric engaging means is provided on said second member of the elongate member, the pivot connection between said first and second members being located between end portions of the first member.

10. A fabric tensioner as claimed in claim 9, wherein said pivot connection between said first and second members is located nearer to the resilient connection of said first member to said mounting means than to the end of said first member distal to said resilient connection.

11. A fabric tensioner as claimed in claim 9, wherein said second member comprises two members telescopically mounted to one another by means of cooperating screw threads.

12. A fabric tensioner as claimed in claim 11, wherein one of said telescopically mounted members is connected to said first member and the other one of said telescopically mounted members is provided with said fabric engaging means.

13. A fabric tensioner as claimed in claim 1, wherein said mounting means is adapted to secure the fabric tensioner to a frame of a marquee by means of a pin, associated with said mounting means, which in use locates in a hole in said frame.

14. A method of using the fabric tensioner claimed in claim 1, the method comprising the steps of mounting the fabric tensioner to a frame of a marquee by means of the mounting means; moving the connecting means to a resiliently bent position; engaging the fabric engaging means with fabric to be tensioned; and moving the connecting means from the resiliently bent position so as to tension said fabric.

15. A method of using a fabric tensioner comprising the steps of:

providing a fabric tensioner having means for mounting the fabric tensioner to a frame of a marquee; and means for connecting said mounting means to a fabric to be tensioned, wherein said connecting means comprises a resiliently bendable elongate member being resiliently connected to said mounting means and comprising means for engaging said fabric so as to permit a transfer of a tensioning force between said fabric and said mounting means the elongate member comprising first and second members pivotally connected to one another wherein the second member is telescopically extendable; mounting the fabric tensioner to a frame of a marquee by mounting means;

moving the connecting means to a resiliently bent position; engaging the fabric engaging means with fabric to be tensioned; and moving the connecting means from the resiliently bent position so as to tension said fabric.

* * * * *